US005712622A

United States Patent [19]

Grossinger et al.

[11] Patent Number: 5,712,622

[45] Date of Patent: Jan. 27, 1998

[54] INTRUSION DETECTOR

[75] Inventors: Israel Grossinger; Shmuel Blit, both of Rehovot; Yaacov Kotlicki, Ramat Gan; Tatiana Kosoburd, Jerusalem, all of Israel

[73] Assignee: Holo or Ltd., Rehovot, Israel

[21] Appl. No.: 588,380

[22] Filed: Jan. 18, 1996

[30] Foreign Application Priority Data

Jan. 19, 1995 [IL] Israel ..... 112396

[51] Int. Cl.[6] ..... G08B 13/18

[52] U.S. Cl. ..... 340/555; 359/566; 359/568; 359/569

[58] Field of Search ..... 340/555, 556; 250/353, DIG. 1, 216, 226, 237 G; 359/566, 568, 569

[56] References Cited

U.S. PATENT DOCUMENTS

| | | | |
|---|---|---|---|
| 3,390,399 | 6/1968 | Leonard | 346/109 |
| 3,471,212 | 10/1969 | Sloane . | |
| 3,991,741 | 11/1976 | Northrup, Jr. et al. | 126/271 |
| 4,204,881 | 5/1980 | McGrew | 136/89 |
| 4,210,391 | 7/1980 | Cohen | 351/161 |
| 4,245,217 | 1/1981 | Steinhage | 340/555 |
| 4,271,358 | 6/1981 | Schwarz | 250/338 |
| 4,293,196 | 10/1981 | Hilbert | 350/452 |
| 4,321,594 | 3/1982 | Galvin et al. | 340/555 |
| 4,340,283 | 7/1982 | Cohen | 351/161 |
| 4,391,495 | 7/1983 | Mazurkewitz | 350/452 |
| 4,429,224 | 1/1984 | Wagli et al. | 250/342 |
| 4,468,658 | 8/1984 | Rossin | 340/567 |
| 4,682,030 | 7/1987 | Rose | 250/338 |
| 4,717,821 | 1/1988 | Messiou | 250/221 |
| 4,749,254 | 6/1988 | Seaver | 350/96.29 |
| 4,787,722 | 11/1988 | Claytor | 350/452 |
| 4,800,278 | 1/1989 | Taniguti | 250/349 |
| 4,893,014 | 1/1990 | Geck | 250/353 |
| 5,055,685 | 10/1991 | Sugimoto et al. | 250/342 |
| 5,237,330 | 8/1993 | Yaacov et al. | 342/28 |
| 5,315,434 | 5/1994 | Mizuno | 359/355 |
| 5,473,471 | 12/1995 | Yamagata et al. | 359/569 |

FOREIGN PATENT DOCUMENTS 27 34 157 2/1979 Germany .

OTHER PUBLICATIONS d'Auria, L., et al., Photolithographic fabrication of thin film lenses, *Optice Communications*, 1972, vol. 5, No. 4, pp. 232–235.

*Primary Examiner*—Jeffery Hofsass
*Assistant Examiner*—Sihong Huang
*Attorney, Agent, or Firm*—Darby & Darby

[57] ABSTRACT

An infrared detector including a sensor which provides an output signal responsive to infrared radiation incident on a face thereof, and a diffractive optical element which directs a substantial portion of incident visible radiation away from the sensor and which has substantially no diffractive effect on incident infrared radiation.

22 Claims, 6 Drawing Sheets

INTRUSION DETECTOR

FIELD OF THE INVENTION

The present invention relates to intrusion detectors in general and, more particularly, to motion detectors using passive infrared detectors.

BACKGROUND OF THE INVENTION

Passive infrared detectors are widely used in intruder, e.g. burglar alarm systems. Since intruder alarm systems are generally designed for detecting the presence of humans, the infrared detectors of such systems generally respond to radiation in the far infrared range, preferably 7–14 micrometers, as typically irradiated from an average person. A typical passive infrared detector includes an infrared sensor, for example a pyroelectric sensor, adapted to provide an electric output in response to changes in radiation at the desired wavelength range. The electric output is then amplified by a signal amplifier and received by appropriate detection circuitry.

To detect movement of a person in a predefined area, typically a room, passive infrared detectors are provided with a discontinuously segmented optical element, e.g. a segmented lens or mirror having at least one optical segment, wherein each segment of the lens or mirror collects radiation from a discrete, narrow field-of-view, such that the fields-of-view of adjacent segments do not overlap. Thus, the infrared sensor receives external radiation through a segmented field-of-view, including a plurality of discrete detection zones separated by a plurality of discrete no-detection zones. The system detects movement of a person from a given zone to an adjacent zone, for example, by detecting a sharp drop or a sharp rise in the sensor's electric output which corresponds to the derivative of the intensity of infrared light received by the sensor.

It is appreciated that abrupt changes in ambient temperature may result in abrupt changes in the output of the pyroelectric sensor and, thus, false alarms may occasionally be detected by the intruder alarm system. To avoid this problem, most intruder alarm systems use a dual-element sensor arrangement including two, adjacent, pyroelectric sensor elements. The two elements and the segmented optics are arranged such that the detection zones of the two elements are interlaced and do not overlap. The electric outputs of the two elements have opposite electrical polarities, such that the absolute value of the net signal received by the amplifier is substantially zero as long as radiation from the same source is received by both elements simultaneously and greater than zero only when radiation is detected by one element and not by the other element. The use of dual-element sensors improves the reliability and the detection resolution of intrusion detectors.

It is well known in the art that ambient visible light may, in certain circumstances, lead to false object detection. For example, ambient light focused on the infrared sensor may be partly absorbed by a window of the sensor, causing the sensor window to be heated and, thus, to radiate infrared radiation which is detected by the sensor. One method known in the prior art for counteracting this phenomenon includes the addition of a remote filter, such as a silicon filter, which filters out incident visible radiation at an out of focus location, relatively far from the sensor. Although the filter may be slightly heated, such heating is not sensed by the sensor. However, the filter method has the drawback of being relatively expensive. An infrared detector using an infrared filter is described, for example, in U.S. Pat. No. 5,055,685.

Another method known in the prior art for counteracting visible light heating consists of providing the window or lens of the detector with a substance which is opaque to visible light but transparent to infrared light, for example forming the detector window or lens of a substance containing a 10 percent pigment of zinc sulfate. The pigment particles, which have substantially no effect on infrared radiation, are operative to absorb and diffuse incident visible radiation.

However, pigmentation of the detector window or lens has a number of drawbacks. Firstly, the pigmented detector window or lens also absorbs and diffuses visible radiation originating from within the detector, particularly light originating from indicator LEDs mounted within the detector, making such indicator LEDs practically invisible through the window or lens. Secondly, existing pigmented windows and lenses are not suitable for outdoor use since they tend to become brittle and less transmissive to infrared light after being exposed to direct sunlight, and/or other outdoor weather conditions, for a long period of time.

Fresnel lenses have grooves of substantially equal distance and variable depth. U.S. Pat. No. 4,787,722 to Claytor describes a Fresnel lens having varied distances between grooves and varying aspherical surfaces. The Fresnel lens of U.S. Pat. No. 4,787,722 includes filtering pigmentation as described above.

SUMMARY OF THE INVENTION

The present invention seeks to provide an improved infrared passive motion detection system.

There is thus provided in accordance with a preferred embodiment of the present invention an infrared detector including:

- a sensor which provides an output signal responsive to infrared radiation incident on a face thereof; and
- a diffractive optical element which directs a substantial portion of incident visible radiation away from the sensor and which has substantially no diffractive effect on incident infrared radiation.

Additionally, in a preferred embodiment of the present invention, the detector includes a lens which focuses infrared radiation on the sensor. According to one preferred embodiment, the diffractive optical element consists of a diffraction grating formed on a surface of the lens which receives the incident radiation. According to another preferred embodiment, the diffractive optical element consists of a diffraction grating formed on a surface of the lens facing the sensor. According to yet another preferred embodiment of the invention, the diffractive optical element consists of a diffraction grating formed on a substrate which is situated between the lens and the sensor. Alternatively, in a preferred embodiment, the lens is situated between the substrate and the sensor.

Additionally or alternatively, in a preferred embodiment of the invention, the detector includes a mirror. The mirror may be used for focusing infrared radiation on the sensor. In one preferred variation of this embodiment of the invention, the diffractive optical element includes a diffraction grating formed on a surface of the mirror. Alternatively, the diffractive optical element includes a grating formed on a separate substrate detached from the mirror.

In a further preferred embodiment of the invention the lens includes a multi-radii Fresnel lens comprising a plurality of sets of spherical surfaces, each set of spherical surfaces having a different radius of curvature.

Additionally, in a preferred embodiment of the invention, the multi-radii Fresnel lens includes a segmented Fresnel lens which provides the sensor with a segmented field of view, the segmented Fresnel lens including a grooved surface comprising a first plurality of spherical surfaces, closer to the center of the Fresnel lens, having a first radius of curvature, and a second plurality of spherical surfaces, closer to the edge of the Fresnel lens, having a second radius of curvature different from the first radius of curvature.

In a preferred embodiment of the invention, the diffractive optical element includes a diffraction grating formed with a spacing of between approximately 1 micrometer and approximately 17 micrometers. Additionally or alternatively, in a preferred embodiment, the diffraction grating is formed with an optical depth of between approximately 0.4 micrometers and approximately 1.0 micrometers.

In accordance with a preferred embodiment of the present invention, the diffractive optical element diffracts a substantial portion of the incident visible radiation and is substantially transparent to the incident infrared radiation.

BRIEF DESCRIPTION OF THE DRAWINGS

The present invention will be understood and appreciated from the following detailed description, taken in conjunction with the drawings in which.

DETAILED DESCRIPTION OF PREFERRED EMBODIMENTS

Figure 1:
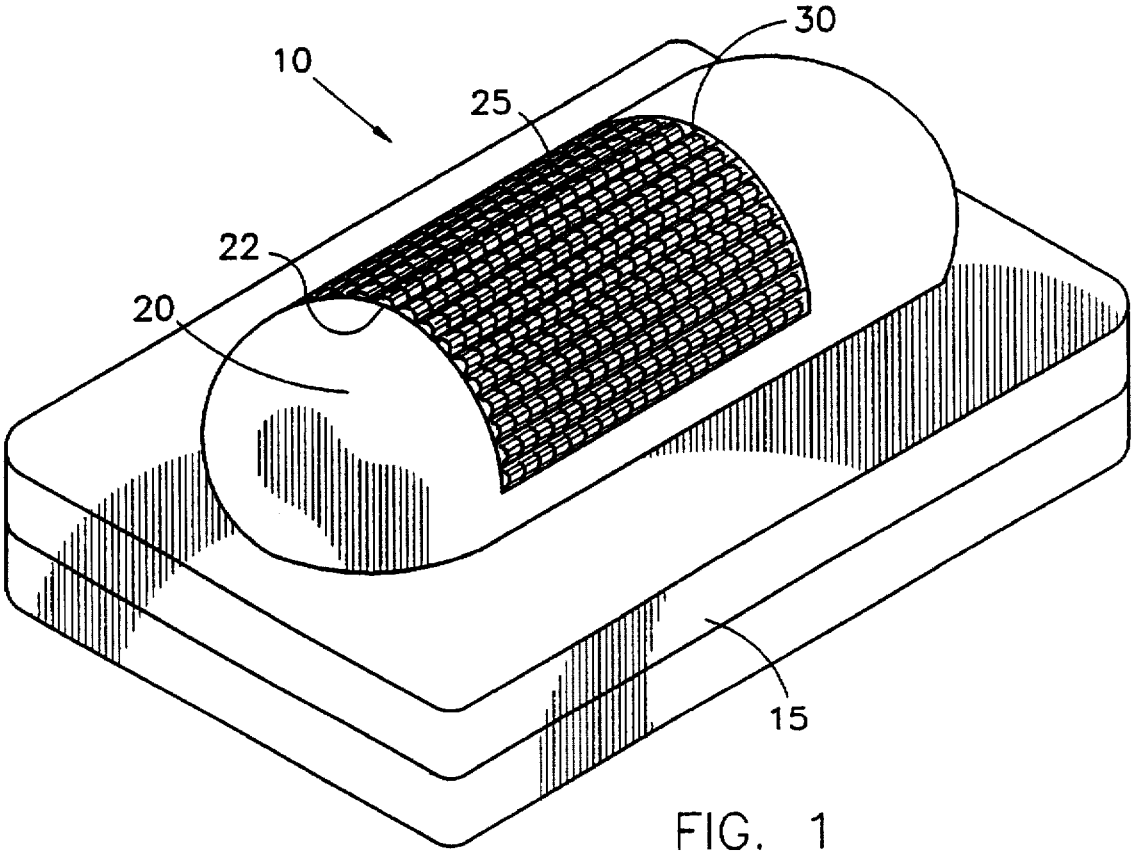
FIG. 1 is a simplified pictorial illustration of an infrared motion detector constructed and operative in accordance with a preferred embodiment of the present invention.

Reference is now made to FIG. 1 which illustrates an infrared motion detector constructed and operative in accordance with a preferred embodiment of the present invention. FIG. 1 depicts an infrared motion detector 10. Motion detector 10 as shown in FIG. 1 preferably includes a housing 15 having a cover portion 20.

Cover portion 20 is formed with an input window 22, preferably fitted with a segmented Fresnel lens 25 providing a segmented field of view. Fresnel lens 25 may be any appropriate lens known in the art or, preferably, it may be a multi-radii Fresnel lens as described below in detail with reference to FIG. 5.

Figure 2:
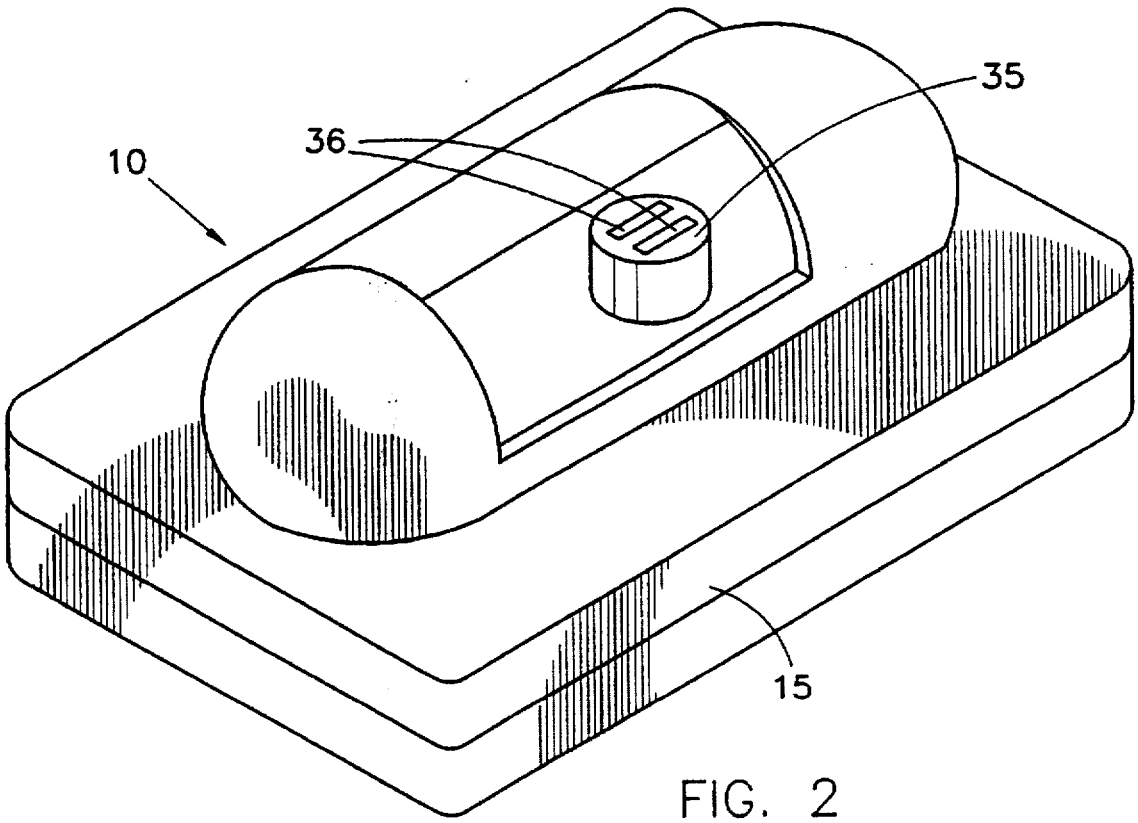
FIG. 2 is a simplified, partially cutaway, schematic illustration of the interior of the motion detector of FIG. 1.

Reference is now made also to FIG. 2 which is a simplified, partially cutaway, schematic illustration of the interior of the motion detector 10 of FIG. 1. The interior of the motion detector 10 comprises an infrared sensor 35, and may also comprise other optional components as are known in the art. Infrared sensor 35, which may be any known type of infrared sensor, is preferably a dual-element sensor including two adjacent sensor-elements 36.

As known in the art, elements 36 and the segmented optics are arranged such that the detection zones of the two elements 36 are interlaced and generally do not overlap. The two elements 36 are designed to have electric outputs of opposite polarities, such that the absolute value of their combined output is substantially zero as long as radiation from the same source is received by both elements simultaneously and greater than zero only when radiation is detected by one element and not by the other element. The use of dual-element sensors improves the reliability and the detection resolution of the intrusion detector.

The Fresnel lens 25 of FIG. 1 is operative to provide a segmented field of view to infrared sensor 35.

In accordance with a preferred embodiment of the present invention, motion detector 10 is fitted with a diffraction grating 30, which is operative to shield infrared sensor 35 within housing 15 from visible radiation incident on the input window 22. The diffraction grating 30 is preferably formed with an optical depth of between 0.4 and 1.0 micrometers, for example 0.56 micrometers, for efficient first order diffraction of wavelengths in the visible range. It should be appreciated that since the depth of diffraction grating 30 is considerably smaller than the infrared wavelengths to be detected, typically on the order of 10 micrometers, grating 30 will diffract only a negligible amount of infrared radiation, while most infrared radiation will proceed, without diffraction, to sensor 35.

Diffraction grating 30 is preferably formed with a spacing, i.e. a distance between adjacent maxima or minima lines of the grating, of between approximately one micrometer and approximately 17 micrometers. The spacing of grating 30 determines the angle of diffraction of light of a given wavelength range, such as visible light. As known in the art, the first-order diffraction angle, $\theta$, is determined by the equation: $\sin\theta=\lambda/L$; wherein $\lambda$ is the wavelength of the diffracted radiation and L is the period, i.e. the spacing, of the grating. Thus, for example, a grating spacing of 10 micrometers yields a first-order diffraction angle of approximately 4 degrees, off-axis, for visible light, which is generally sufficient to prevent diffracted visible light from reaching sensor 35.

It is appreciated that while a substantial portion of the visible radiation is diffracted, some visible radiation is not diffracted and, thus, some visible radiation reaches sensor 35. Therefore, in some preferred embodiments of the invention, diffraction grating 30 is used in conjunction with additional means (not shown in the drawings) for shielding sensor 35 from visible radiation, for example using pigmented optical elements in detector 10. It should be appreciated, however, that since substantial shielding is performed by grating 30, some of the undesired effects of the additional shielding means are avoided. For example, if pigmentation is used, the amount of pigment can be reduced considerably, thereby enabling the use of indicator light emitting diodes (LEDs) within housing 15. The reduced pigmentation also makes the detector more durable in outdoor conditions.

The diffraction grating 30 may be manufactured by any one of the methods known in the art such as evaporation, etching, ruling or embossing. Grating 30 may be formed on the outer or inner surface of Fresnel lens 25, as shown in FIG. 2, or on other optical elements of motion detector 10 or on a separate optical element, depending on the specific embodiment. According to one preferred embodiment, an impression of grating 30 is included in a mold used for injection or compression molding of Fresnel lens 25, such that grating 30 is an integral part of the molded lens 25.

While grating 30 has been described as a one directional grating, having a substantially fixed spacing between substantially parallel minima and maxima and having a substantially constant optical depth, other configurations of grating 30 may yield comparable or, even, improved results. According to one such configuration, grating 30 includes a multi-directional grating having minima and maxima lines along a plurality of directions which may be selected randomly or according to a predetermined design. Additionally or alternatively, the spacing and optical depth of grating 30 may be varied, within predetermined limits, maintaining a desired spacing and optical depth on the average.

Figure 3A:
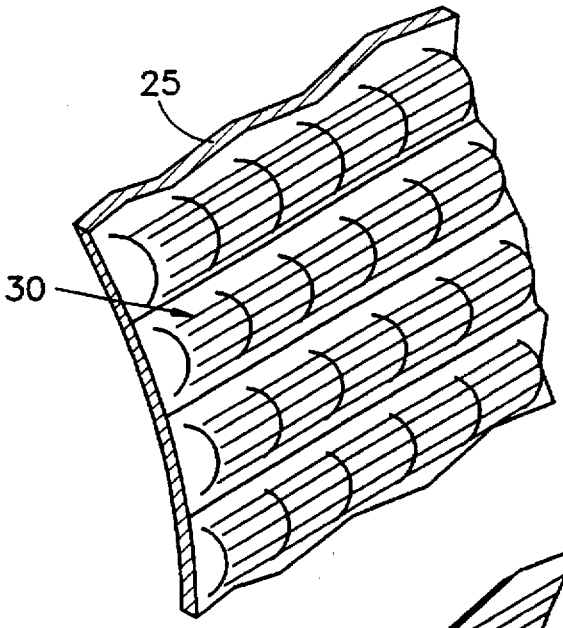
FIGS. 3A–3C are simplified pictorial illustrations of three preferred embodiments of a portion of the motion detector of FIG. 1.
Figure 3B:
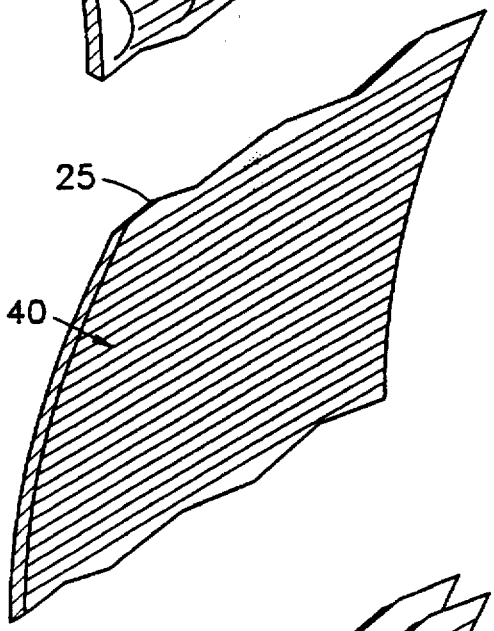

Reference is now made to FIGS. 3A–3D, which are simplified pictorial illustrations of four preferred embodiments of a portion of the motion detector of FIG. 1. In FIG. 3A, the grating 30 is shown as formed on the front or outside surface of Fresnel lens 25, i.e. on the surface facing away from the infrared sensor. In FIG. 3B, an alternative preferred embodiment is shown in which a grating 40 is formed on the back or inside surface of Fresnel lens 25, i.e. on the surface facing the infrared sensor. Although FIG. 3A indicates that segmented Fresnel optics are formed on the external surface of lens 25, it should be appreciated that, additionally or alternatively, segmented Fresnel optics may be formed on the back surface of lens 25.

Figure 3C:
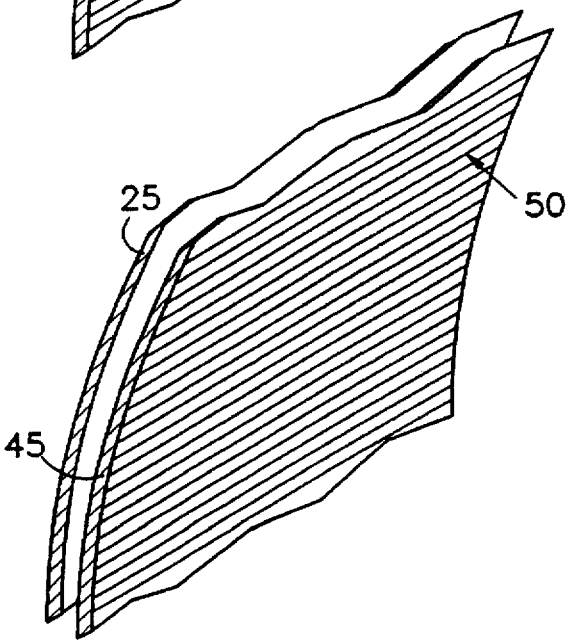

In FIG. 3C, another alternative preferred embodiment is shown in which a grating 50 is formed on a separate substrate 45 which is preferably located between Fresnel lens 25 and the infrared sensor 35. The distance between substrate 45 and lens 25, preferably selected so as to provide optimal results, is typically very short compared to the distance between substrate 45 and sensor 35. Alternatively, in a preferred embodiment of the invention, substrate 45 may be located in front of lens 25 such that lens 25 is between substrate 45 and sensor 35.

Figure 3D:
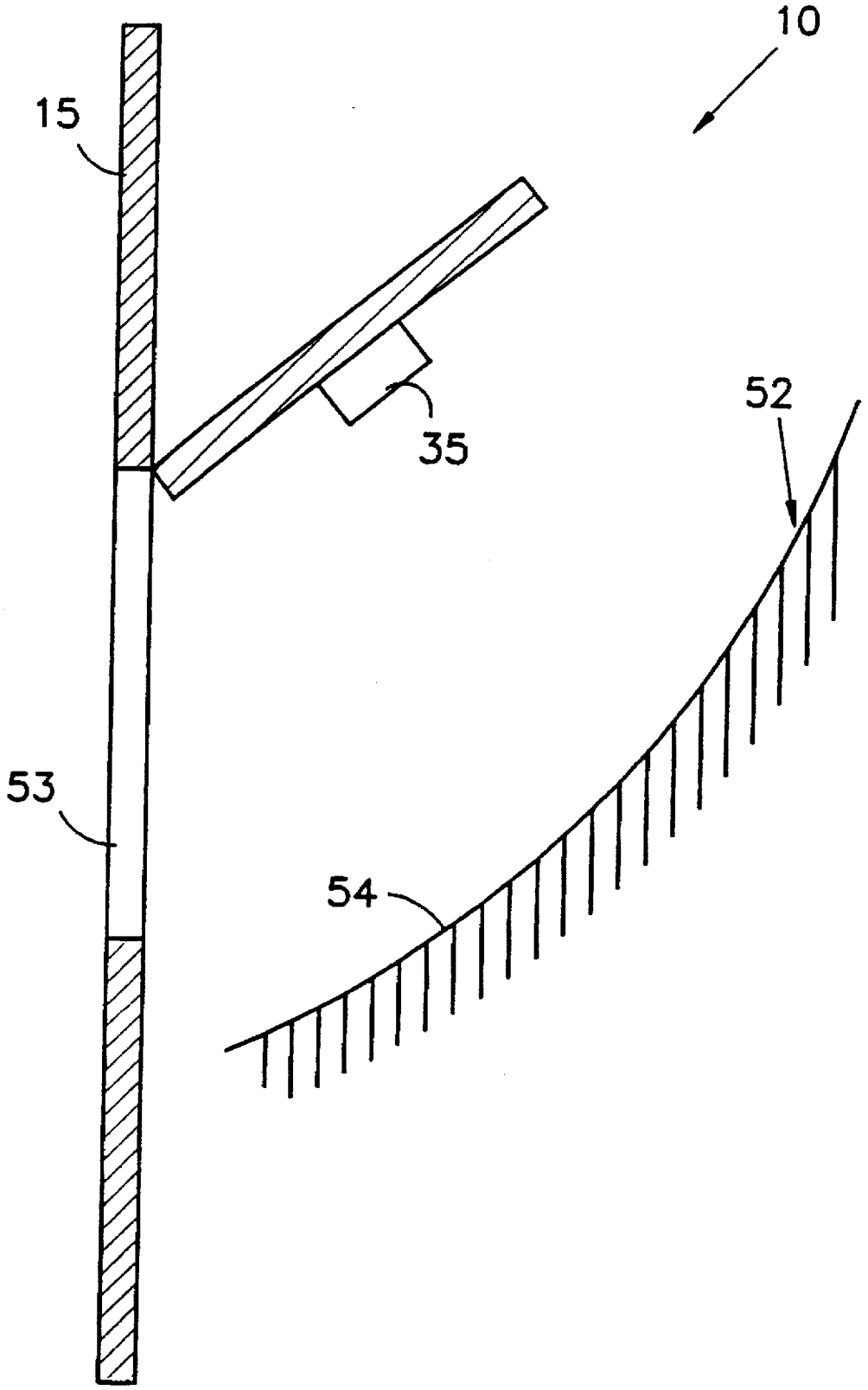
FIG. 3D is a simplified, cross-sectional, illustration of a motion detector in accordance with an alternative, preferred, embodiment of the invention.

In FIG. 3D, yet another alternative preferred embodiment is shown in which a converging mirror 52 is part of the light path between an input window 53 and sensor 35. A grating 54 in accordance with the present invention is preferably formed on the surface of mirror 52. Grating 54 can also be formed on either surface of input window 53 or on a separate optical element, such as substrate 45 of FIG. 3C, preferably situated on the light path between window 53 and sensor 35.

It should be appreciated that the infrared detector of the present invention may use other suitable optical configurations known in the art, for example combinations of lenses and mirrors as described in U.S. Pat. Nos. 4,429,224 and 4,703,171. It should be appreciated that the present invention can be incorporated into any configuration of lenses and/or mirrors by forming a grating, such as gratings 40, 50 and 54, at a suitable location on the light path defined by the specific configuration.

Figure 4:
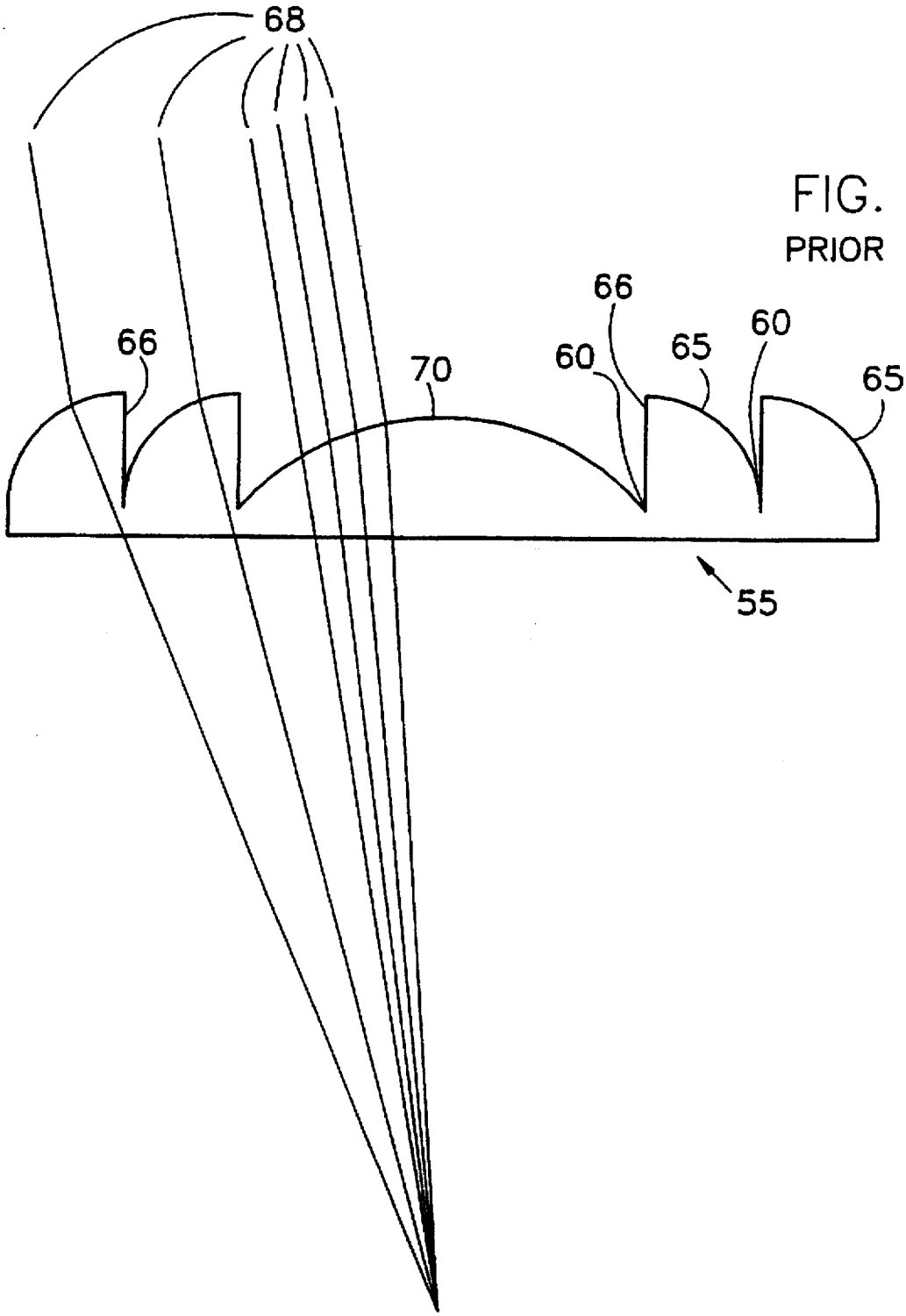
FIG. 4 PRIOR ART
FIG. 4 is a simplified pictorial illustration of a side cross-sectional view of a prior art optical element.

Reference is now made to FIG. 4, which is a simplified pictorial illustration of a side cross-sectional view of a prior art optical element. FIG. 4 comprises a Fresnel lens 55 having a plurality of grooves 60 formed in its surface. The Fresnel lens 55 includes a plurality of spherical or aspherical surfaces 65 and a plurality of vertical steps 66, substantially perpendicular to the plane of incidence of lens 55, whereby each groove 60 is defined between a spherical or aspherical surface 65 and an adjacent step 66. The incident radiation is focused substantially in accordance with one focus, designed to direct all incident radiation to sensor 35.

Figure 5:
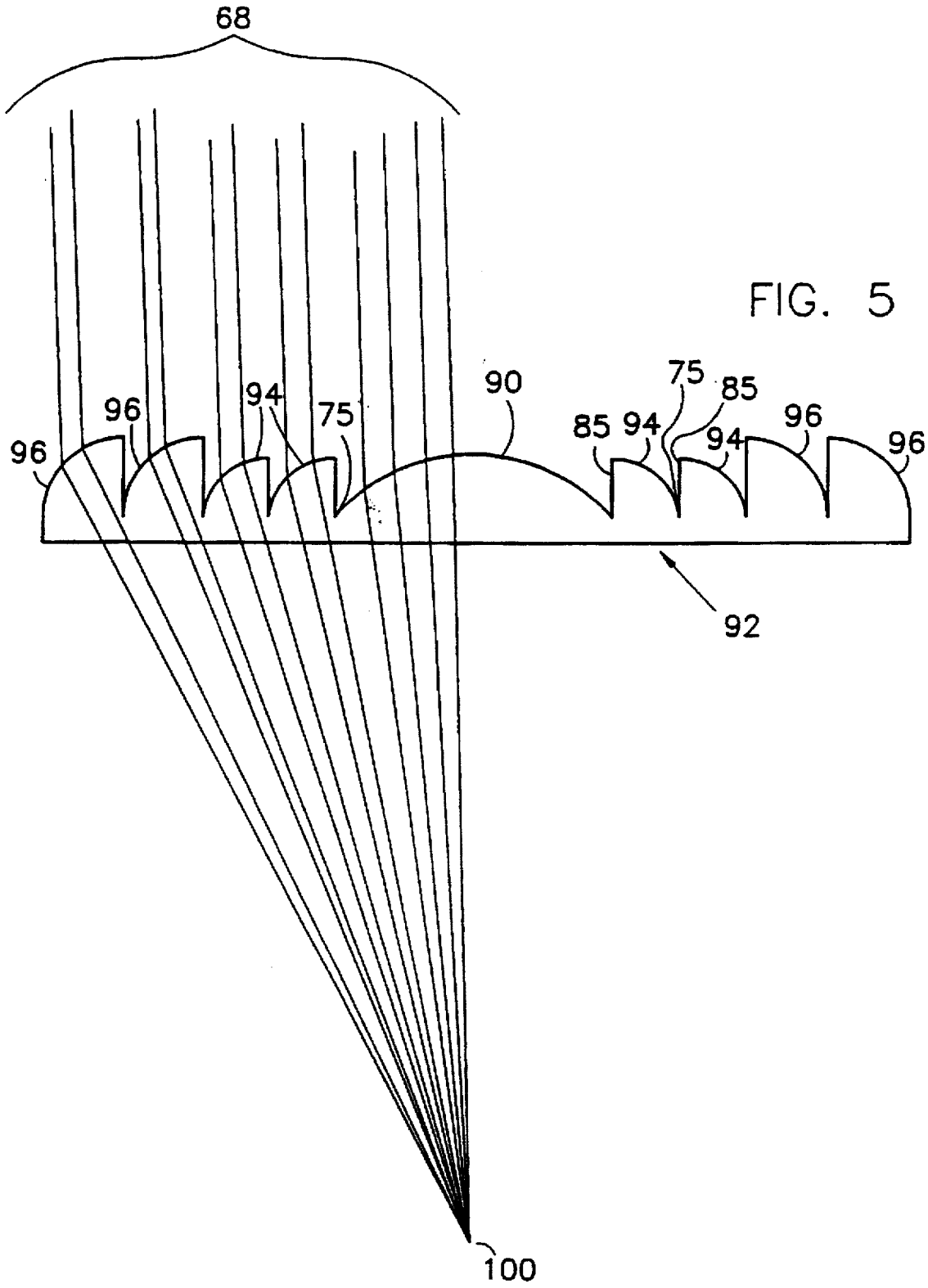
FIG. 5 is a simplified pictorial illustration of a side cross-sectional view of an optical element in accordance with a preferred embodiment of the present invention.

Reference is now made to FIG. 5 which is a simplified pictorial illustration of a side cross-sectional view of an optical element in accordance with preferred embodiment of the optical element of FIG. 5. The optical element of FIG. 5 includes a multi-radii Fresnel lens 92 having a plurality of grooves 75 formed in its surface as in prior art Fresnel lens 55 (FIG. 4). However, in place of the uniformly spherical or aspherical surfaces 65 of prior art Fresnel lens 55, multi-radii Fresnel lens 92 comprises a plurality of discrete sets of spherical surfaces, each set of spherical surfaces having a different radius of curvature.

FIG. 5 shows a preferred embodiment of the invention in which multi-radii lens 92, which may be used in place of Fresnel lens 25 of FIG. 1, comprises a first set of spherical surfaces 94 and a second set of spherical surfaces 96, each set having a different radius of curvature. In a preferred embodiment of the invention, the two sets of spherical surfaces, 94 and 96, are shaped and positioned so as to refract incident infrared radiation to a common focal point 100, preferably on sensor 35. It is appreciated that multi-radii Fresnel lens 92 may comprise more than two sets of spherical surfaces, each having a different radius of curvature and all adapted to refract light to onto sensor 35.

It should be appreciated that the use of two or more, different, radii of curvature can be utilized to reduce spherical aberrations from lens 92, for example, by conforming the curvature of surfaces 94 to the curvature near the center of a corresponding parabolic lens while conforming the curvature of surfaces 96 to the curvature near the edges of the corresponding parabolic lens. It should also be appreciated that spherical aberrations can be further reduced when more than two sets of surfaces are used, whereby the curvature of each set of surfaces conforms to a different, respective, location of the corresponding parabolic lens.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention is defined only by the following claims:

We claim:

1. An infrared detector comprising:

a sensor which provides an output signal responsive to infrared radiation incident on a face thereof; and a diffractive optical element which diffractively directs a substantial portion of incident visible radiation away from the sensor and which has substantially no diffractive effect on incident infrared radiation.

2. A detector according to claim 1 and also comprising a lens which focuses infrared radiation on the sensor.

3. A detector according to claim 2 wherein the lens comprises a multi-radii Fresnel lens comprising a plurality of sets of spherical surfaces, each set of spherical surfaces having a different radius of curvature.

4. A detector according to claim 3 wherein the multi-radii Fresnel lens comprises a segmented Fresnel lens which provides the sensor with a segmented field of view, the segmented Fresnel lens including a grooved surface comprising:

a first plurality of spherical surfaces, closer to the center of the Fresnel lens, having a first radius of curvature; and a second plurality of spherical surfaces, closer to the edge of the Fresnel lens, having a second radius of curvature different from the first radius of curvature.

5. A detector according to claim 2 wherein the diffractive optical element comprises a diffraction grating formed on a surface of the lens which receives the incident radiation.

6. A detector according to claim 2 wherein the diffractive optical element comprises a diffraction grating formed on a surface of the lens facing the sensor.

7. A detector according to claim 2 wherein the diffractive optical element comprises a diffraction grating formed on a substrate situated between the lens and the sensor.

8. A detector according to claim 2 wherein the diffractive optical element comprises a diffraction grating formed on a substrate and wherein the lens is situated between the substrate and the sensor.

9. A detector according to claim 1 and comprising a mirror.

10. A detector according to claim 9 wherein the mirror focuses infrared radiation on the sensor.

11. A detector according to claim 9 wherein the diffractive optical element comprises a diffraction grating formed on a surface of the mirror.

12. A detector according to claim 9 wherein the diffractive optical element comprises a diffraction grating formed on a separate substrate detached from said mirror.

13. A detector according to claim 1 wherein the diffractive optical element comprises a diffraction grating formed with a spacing of between approximately 1 micrometer and approximately 17 micrometers.

14. A detector according to claim 13 wherein the spacing is substantially constant.

15. A detector according to claim 13 wherein the spacing is varied in accordance with a predetermined design.

16. A detector according to claim 13 wherein the spacing is varied randomly.

17. A detector according to claim 1 wherein the diffractive optical element comprises a diffraction grating formed with an optical depth of between approximately 0.4 micrometers and approximately 1.0 micrometers.

18. A detector according to claim 17 wherein the optical depth is substantially constant.

19. A detector according to claim 17 wherein the optical depth is varied in accordance with a predetermined design.

20. A detector according to claim 17 wherein the optical depth is varied randomly.

21. A detector according to claim 1 wherein the diffractive optical element comprises a multi-directional diffraction grating.

22. A detector according to claim 1 wherein the diffractive optical element diffracts a substantial portion of incident visible radiation and is substantially transparent to incident infrared radiation.

* * * * *